United States Patent [19]

Bureau

[11] 4,120,549

[45] Oct. 17, 1978

[54] SHEET METAL TOOL CHEST SUPPORT WITH SLIDING WORK SHELF

[76] Inventor: Harvey Lee Bureau, 8 Pleasantdale Ave., Waterville, Me. 04901

[21] Appl. No.: 791,412

[22] Filed: Apr. 27, 1977

[51] Int. Cl.[2] ..... A47B 88/00

[52] U.S. Cl. ..... 312/253; 312/281; 312/335; 280/47.35

[58] Field of Search ..... 280/47.35; 312/250, 312/253, 279, 281, 330, 330 SM, 335, 111, D33, 209, 269

[56] References Cited

U.S. PATENT DOCUMENTS

| | | | |
|---|---|---|---|
| 172,686 | 1/1876 | Ayres | 312/279 |
| 394,878 | 12/1888 | Pershing | 312/279 |
| 869,735 | 10/1907 | Rubin | 312/335 |
| 1,135,704 | 4/1915 | Loftin | 312/335 |
| 1,668,323 | 5/1928 | Coppes | 312/338 |
| 2,531,381 | 11/1950 | Abrahamson | 312/281 |
| 2,678,489 | 5/1954 | Ratzlaff et al. | 312/281 |
| 2,857,233 | 10/1958 | Reiss et al. | 312/341 |
| 2,903,316 | 9/1959 | Schmidt | 312/253 |
| 2,903,316 | 9/1959 | Schmidt | 312/253 |
| 2,981,549 | 4/1961 | Hotton | 280/47.35 |
| 3,876,270 | 4/1975 | White | 312/341 N |
| 3,997,218 | 12/1976 | Wolf et al. | 312/279 |

FOREIGN PATENT DOCUMENTS

| | | | |
|---|---|---|---|
| 3,258 of | 1890 | United Kingdom | 312/281 |
| 1,355,656 | 6/1974 | United Kingdom | 312/281 |

*Primary Examiner*—Victor N. Sakran
*Attorney, Agent, or Firm*—Pearson & Pearson

[57] ABSTRACT

A support for elevating a tool chest to a spaced distance above the level of the work bench area of a roll-around cabinet comprises a hollow shell defined by an upstanding front wall, rear wall and pair of side walls all of uniform height and of sheet material. Angle irons are secured peripherally around the upper inside of the walls to receive and seat the bottom of the chest. There are no sliding drawers in the support but a shelf slides out from the bottom of the front wall. An opening in the back wall permits storage within the support. A floor extending across the interior of the support is configured to form a pair of side tracks for the shelf.

6 Claims, 4 Drawing Figures

Fig. 1
PRIOR ART
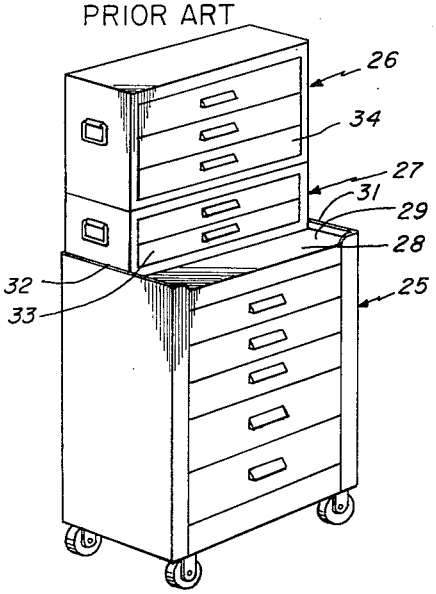
Fig. 2
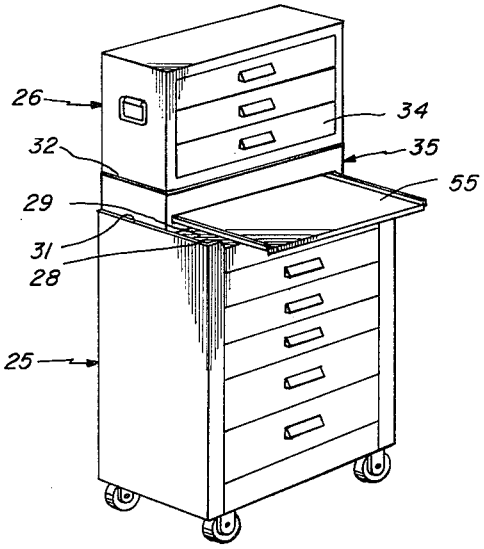
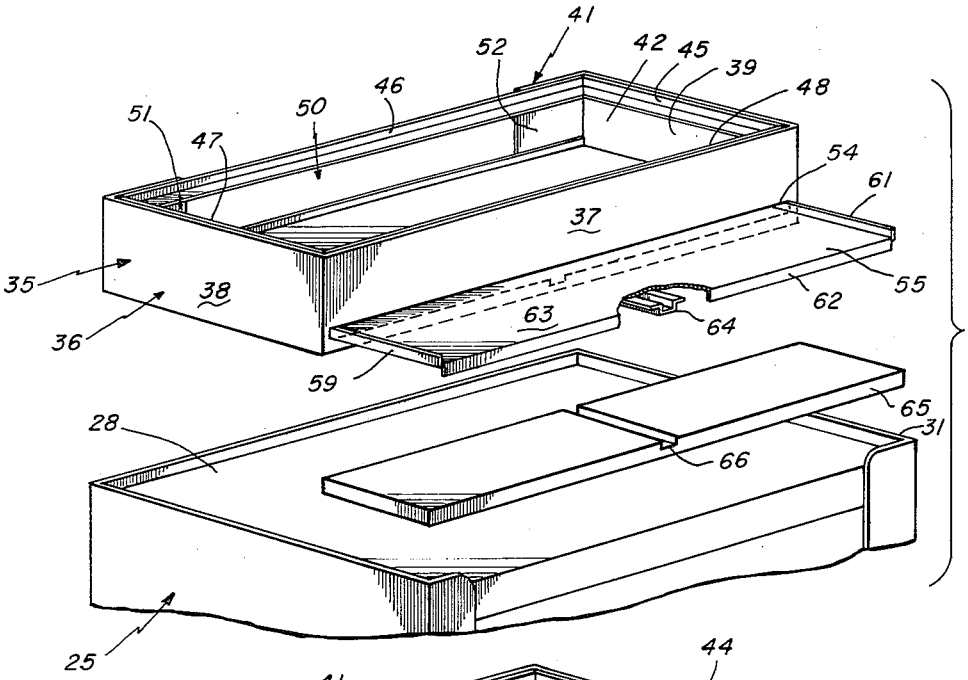
Fig. 3
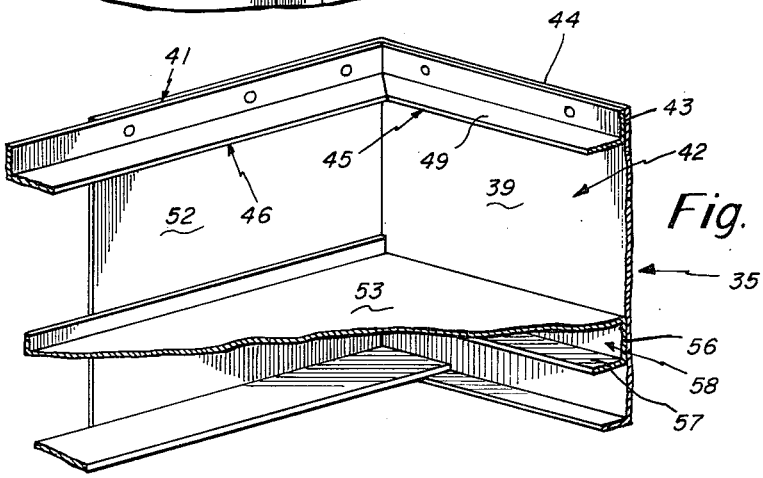
Fig. 4

SHEET METAL TOOL CHEST SUPPORT WITH SLIDING WORK SHELF

BACKGROUND OF THE INVENTION

Roll-around cabinets for storage of the tools of mechanics are well known and usually are used in conjunction with a tool chest, having multiple pull out drawers in its front wall. Such roll around cabinets have an upper surface equal in width to the width of the tool chest but of greater depth so that the chest may extend across the rear of the cabinet surface with a portion, such as a 6 inch wide strip exposed at the front to serve as a work bench. However, if tools or work pieces are supported thereon, the lowermost drawer in the chest cannot be pulled out without danger of knocking the work bench parts onto the floor.

The work bench area on the upper surface of such cabinets is thus not only impractical to use but it is of too small an area to permit any work of any size to be accomplished thereon.

Tool chests have been proposed in which there is built in space below the level of the bottommost pull-out drawer, that space being occupied by a front cover when not in use, as in U.S. Pat. No. 1,984,345 to Kennedy of Dec. 11, 1934. However, most tool chests do not have such space below the bottom drawer because it is more efficient to use such space for tools and parts.

It has also been proposed to provide storage space below the bottom drawer of a roll-around tool cabinet as in U.S. Pat. No. 2,981,549 to Hotton of Apr. 25, 1961, but such space proximate floor level does not produce any increased work bench area at waist level.

In U.S. Pat. No. 2,903,316 to Schmidt of Sept. 8, 1959, a skeletonized support structure is disclosed for elevating a tool chest above a surface but the two upright end brackets must be affixed to the side edges of the top by screws and a rear bracket must be similarly affixed. While such a structure provides work space under the tool chest, it is not easily removable, it does not form a sheet metal storage enclosure and it includes no built-in slidable shelf for increasing the work bench area.

SUMMARY OF THE INVENTION

In this invention, a support of uniform height is provided to elevate the tool chest in the range of 3 to 6 inches above the level of the rear portion of the top surface of a roll-around tool cabinet, or of a work bench. A conventional, multiple drawer, tool chest may thus be used with a conventional cabinet, and the lowermost pull out drawer will not dislodge parts or tools resting on the narrow bench of the cabinet.

The support is formed by a sheet metal upstanding wall, having a front free of pull-out drawers, a pair of integral side walls and a back wall having an opening to give access to the enclosure formed by the support.

A slide out shelf of at least the area in plan of the tool chest is housed within the enclosure but may be extended to double or triple the available work bench area at waist level.

The support includes angle irons affixed around the upper periphery to support the chest while lending strength to the sheet metal walls and a sheet metal floor within the enclosure is configured to form a pair of side tracks for guiding the pull out shelf.

BRIEF DESCRIPTION OF THE DRAWING

FIG. 1 is a perspective view of a typical tool chest, supported on a front pull-out drawer section in turn supported on a roll around tool cabinet, as used in the prior art;

FIG. 2 is a perspective view similar to FIG. 1 showing my new pull-out shelf spacer supporting a tool chest on a roll around tool cabinet;

FIG. 3 is an enlarged, fragmentary exploded view of the spacer of the invention; and FIG. 4 is a still further enlarged fragmentary perspective view of an inside corner of the enclosure within the spacer of the invention.

DESCRIPTION OF A PREFERRED EMBODIMENT

In FIG. 1 a typical matching combination of roll-around tool cabinet 25, tool chest 26 and drawer section 27 is shown, all being of sheet metal with welded construction and supplied by manufacturers such as Snap-on Tools Corporation of Kenosha, Wisconsin to mechanics in many trades.

It will be noted that the tool chest 26 and drawer section 27 are the same width as the upper surface 28 of cabinet 25 but of less depth, thereby exposing a narrow work bench strip 29 upon which tools and work pieces may be placed.

An upstanding peripheral rim flange 31 usually extends around the upper horizontal surface 28 of cabinet 25, the bottom 32 of the tool chest 26 fitting snugly therewithin at the rear of the surface 28 but being removable therefrom.

It will be apparent from FIG. 1 that when the lowermost drawer 33 of section 27, or when the lower drawer 34 of chest 26 if resting directly on surface 28, is pulled out it will dislodge any tools or workpieces on the narrow work bench strip 29. Bottom drawer frustration caused by an accumulation of tools, parts, etc. on a small work bench is a continual aggravation to mechanics who work from the front of such tool chests.

In this invention a support 35 is interposed between the tool chest or drawer section and the roll-around cabinet or work bench to elevate the lower drawer at least 3 and up to 6 inches above the upper surface 28 and its narrow exposed work bench strip 29. In FIG. 2 the support 35 is shown as substituted for the drawer section 27 and it should be noted that it is free of front pull-out drawers.

The support 35 is formed of sheet material, such as the sheet steel 36 of which the cabinet 25 and chest 26 are formed. It includes an upstanding front wall 37, a pair of integral opposite side walls 38 and 39 and back wall means 41, all of predetermined, uniform height preferably ranging between 3 to 6 inches and defining a hollow enclosure 42 equal in plan dimensions to the plan dimensions of the bottom 32 of tool chest 26.

Extending peripherally around the inner surface 43 of the upper edge 44 of the upstanding wall 37, 38 and 39, and forming part of back wall means 41, are sections, or strips, of angle iron 45, 46, 47 and 48, the term "angle iron" being used to describe $\frac{3}{8}$ inch $\times$ $\frac{1}{2}$ inch 16-guage $\pm$ steel of right angular cross section, with the $\frac{1}{2}$ inch portion 49 horizontal and inturned to form a seat for receiving and supporting the bottom 32 of tool chest 26.

Back wall means 41 not only includes the angle section 48 but also a pair of short spaced apart rear wall sections 51 and 52 jointly defining an opening 50 which gives access to the enclosure 42 so that it may be used for storage.

A sheet metal floor 53 is provided within support 35 and extending across enclosure 42, just above the level of the front opening 54 for a slide out shelf 55. The floor 53 includes a pair of opposite, integral down turned flanges such as 56 each welded to the inside of a side wall 38 or 39, the flanges 56 each having an inturned flange such as 57 extending horizontally therefrom to form tracks, or channels such as 58 for supporting and guiding shelf 55 during its extension.

The shelf 55 is formed of sheet metal such as 18-guage steel and includes a pair of opposite upturned, integral side flanges 59 and 61 which are slidably received in the tracks 58 and includes a downturned integral front flange 62 serving as a stop.

The opening 54 is in the lower portion of the front wall 37 at a level well below the level of the lowermost drawer 34 in tool chest 26 so that the drawer may be opened at will without dislodging tools or workpieces on the shelf 55. Preferably the shelf 55 is equal in depth to the depth of the upper surface 28 of cabinet 25 so that its major portion is normally housed in enclosure 42 of support 35 but a minor portion extends over the work bench strip 29. As shown in FIG. 2, when shelf 55 is withdrawn and extended it thus provides substantially increased work bench area doubling or tripling the area of strip 29, and being equal in exposed dimensions to the dimensions of upper surface 28.

As shown in FIG. 3, since the horizontal portion 63 of shelf 55 is of sheet metal, it is preferred to affix at least one channel element 64 of sheet metal to the underside thereof behind flange 62 and extending from front to back of the shelf. Preferably also a strip, or block, 65 of material such as plywood is provided with a groove 66 for the channel element 64 to provide a firm support reinforcing the sheet metal shelf 55 when extended.

In operation, it is only necessary to lift the tool chest off the cabinet, place the support on the rear of the upper surface of the cabinet using the pre-cut plywood block under the portion of the shelf which projects over the narrow work bench strip of the cabinet. This locks the support in place and the tool chest may then be reinstalled in the seat formed around the top of the support. The mechanic then has a matching sheet metal support with a rear opening for storage, a narrow bench strip spaced well below the lowermost drawer in the chest for accomodating tools without dislodgment, and when more work area is needed, the work shelf may be extended to about 18 inches.

I claim:

1. In combination:

a roll-around tool cabinet having an upper, horizontal work bench surface of predetermined width and depth;

a multiple drawer tool chest having a front with at least one slide out drawer at the bottom thereof, and a bottom surface of less depth than, but equal width to, said upper work bench surface said tool chest being removably supported at the rear of said work bench surface with a narrow forward portion of said work bench surface exposed as a shelf-like strip;

and a removable support interposed between said chest and cabinet, said support including an upstanding front wall and a pair of integral upstanding side walls, all of sheet metal, and of uniform height within the range of 2 to 6 inches, said support removably seating said chest at a level well above the upper surface of said cabinet with said shelf-like strip exposed;

said support defining a hollow enclosure having back wall means including an access opening for access to said enclosure and having a shelf opening in the lower portion of said upstand-front wall;

a shelf slidable in said shelf opening, said shelf being coextensive in depth and width with said work bench surface, having a rearward portion normally housed in the lower portion of said enclosure and having a forward portion normally extending outside said support and covering said shelf-like strip;

said shelf being slidable from said normal position to a position in which said forward portion extends forwardly beyond said shelf-like strip to provide the normal work bench area of said cabinet, said slide-out shelf is formed of sheet metal, the side edges thereof being bent upwardly to form side flanges and the front edge being bent downwardly to form a stop, said shelf includes a plurality of channel members of sheet metal affixed to the underside thereof and extending from front to back to reinforce said shelf when extended, and floor means extending across the interior of said enclosure for slidably guiding said shelf.

2. A combination as specified in claim 1 wherein:

each said upstanding side wall includes a strip of right angular cross section along the inside of the top edge thereof for seating and supporting said tool chest.

3. A combination as specified in claim 3 wherein:

said back wall means comprises an elongated metal strip of right angular cross section extending across the upper portion of the back of said support and integrally connected to said side wall strips at the level thereof for seating and supporting said tool chest.

4. A combination as specified in claim 1 plus:

elongated steel strips of right angle cross section extending entirely around the inner upper periphery of said support, and forming a seat for receiving and supporting the bottom of said tool chest, the portion thereof extending along the back of said spaces constituting said back wall means.

5. A combination as specified in claim 1 wherein:

said floor means comprises a sheet metal floor in said support, the upper surface thereof forming a platform for articles stored therein through said rear opening and the side edges of said floor being bent downwardly and then inwardly to form a track receiving said shelf and guiding the same during withdrawal through the opening in said front wall.

6. A combination as specified in claim 1 wherein:

the work bench surface of said roll around tool cabinet includes an upstanding peripheral rim flange extending around the upper horizontal work bench surface thereof; and said shelf opening, and said shelf slidable therein are at a predetermined height above said work bench surface to permit said shelf to clear said rim flange.

* * * * *